US005219170A

United States Patent [19]

Ledford

[11] Patent Number: 5,219,170

[45] Date of Patent: Jun. 15, 1993

[54] ACTION BOARD GAME APPARATUS

[76] Inventor: Kevin D. Ledford, 1857 E. Marian St., Lot #8, Shelby, N.C. 28150

[21] Appl. No.: 968,343

[22] Filed: Oct. 29, 1992

[51] Int. Cl.[5] ..... A63F 3/00

[52] U.S. Cl. ..... 273/281; 273/85 E; 273/248; 273/287; 446/294

[58] Field of Search ..... 273/85 E, 86 C, 241, 273/242, 243, 248, 258, 281, 287; 446/1, 281, 282, 284, 285, 289, 294

[56] References Cited

U.S. PATENT DOCUMENTS

| | | | |
|---|---|---|---|
| 1,317,880 | 10/1919 | Lyman | 273/287 |
| 1,421,656 | 7/1922 | Abele | 273/281 X |
| 2,562,822 | 7/1951 | Sanger | 273/287 X |
| 2,614,841 | 10/1952 | Joseph | 273/281 X |
| 4,066,263 | 1/1978 | Balas et al. | 273/281 X |
| 4,334,680 | 6/1982 | Liverside | 273/287 X |
| 4,542,904 | 9/1985 | Parlato | 273/281 X |

FOREIGN PATENT DOCUMENTS

| | | | |
|---|---|---|---|
| 1524371 | 9/1978 | United Kingdom | 273/281 |

*Primary Examiner*—William Stoll
*Attorney, Agent, or Firm*—John R. Flanagan

[57] ABSTRACT

An action board game apparatus includes an inclined game board having openings therein, game pieces mountable on the game board partially through selected ones of the openings and capable of being pushed through the openings upon application of a sufficient predetermined force on an upper portion of each game piece extending above the game board, and a rotary driver movable across the game board. The driver has an elongated shaft and wheels attached to opposite shaft ends. The game board includes parallel linear tracks attached along opposite side edges of the board. The game board openings are arranged in parallel side-by-side rows also extending parallel to the guide tracks. The tracks receive the wheels and permit rolling movement to adapt the driver to move across the game board by itself with its shaft spaced above the game board and passing over upper portions of the game pieces. The driver also has driving elements mounted on the shaft and extending in a radial relation therefrom and disposed in an angularly offset helical relation to one another about and along the shaft such that as the rotary driver moves across the game board the driving elements of the driver are brought into alignment with only certain ones of the openings which are unknown in advance so as to apply the predetermined force on the upper portion of the game pieces mounted through those openings and push the game pieces therethrough.

24 Claims, 2 Drawing Sheets

ACTION BOARD GAME APPARATUS

BACKGROUND OF THE INVENTION

1. Field of the Invention

The present invention generally relates to board-type games and, more particularly, is concerned with an action board game apparatus.

2. Description of the Prior Art

Games utilizing playing boards have been enjoyed for many years by persons in a wide range of age groups. One category of such games, which requires more physical action to play than others, have an arrangement of holes through the board and utilize a plurality of playing pieces, such as pegs or balls, either for fitting through or for playing with respect to the holes. Representative examples of such category of prior art games are those disclosed in U.S. Pat. Nos. to Abele (1,421,656), Joseph (2,616,841), Balas et al (4,066,263) and Parlato (4,542,904).

However, since the introduction of video games which provide continuous action, many young players have lost interest in games utilizing playing boards for reason that these games fail to require sufficient action to capture their attention. A drawback of video games is their high cost which makes it difficult for a broad cross-section of the younger population to have the opportunity to play them.

Consequently, the inventor herein has perceived a need for a board game which will involve a greater degree of action on the part of players than was traditionally the case so as to better hold the attention of younger players. Further, the inventor has concluded that the full potential of games which utilize playing boards has not yet been reached.

SUMMARY OF THE INVENTION

The present invention provides an action board game apparatus designed to satisfy the aforementioned need. The action board game apparatus of the present invention comprises: (a) a game board having a plurality of openings defined therein and guide means defined therealong; (b) a plurality of game pieces mountable on the game board partially through selected ones of the openings and capable of being pushed through and of dropping below the openings upon application of a predetermined force on an upper portion of each game piece extending above the game board; and (c) a rotary driver movable across the game board. The rotary driver includes an elongated shaft and a pair of wheels attached to opposite ends of the shaft for adapting the driver to move across the game board along the guide means with the shaft spaced above the game board and above upper portions of the game pieces mounted partially through the openings on the game board.

The rotary driver also includes a plurality of driving elements mounted on the shaft and extending in a radial relation therefrom. The driving elements are disposed in an angularly offset relation to one another about the shaft such that as the rotary driver moves across the game board the driving elements are brought into alignment with only certain ones of the openings which are unknown in advance so as to apply sufficient predetermined force on the upper portion of the game pieces mounted through the certain openings to push the game pieces therethrough.

More particularly, the guide means includes a pair of parallel linear tracks attached to and extending along opposite side edges of the board. The tracks receive the wheels of the rotary driver therein and are configured to permit rolling movement of the wheels therealong. The openings in the game board are arranged in an array of generally parallel side-by-side rows extending generally parallel to the guide tracks. The driving elements are disposed in a helical arrangement along and about the shaft. Preferably, each driving element has the configuration of a boot.

Also, the guide tracks includes stop elements disposed at the opposite ends thereof so as to prevent the rotary driver from rolling off the ends of the tracks. Further, the guide means includes an actuator element mounted to at least one of the tracks and being movable between a blocking position relative to the rotary driver wherein the actuator element retains the driver in a home position at corresponding one ends of the tracks and one end of the game board and an unblocking position relative to the rotary driver wherein the actuator element permits movement of the driver across the board.

The apparatus also includes a pair of legs mounted to undersides of each of the tracks so as to support the game board in a spaced relation above a support surface. Given ones of the pairs of legs are longer than given others of the pairs of legs such that the game board is supported in an inclined orientation above and relative to the support surface so that the rotary driver will roll by itself along the tracks.

Furthermore, the game board includes an upper panel made of substantially rigid material, and a lower panel made of resiliently flexible material. The openings in the game board include a plurality of top holes through the upper panel and a plurality of bottom holes through the lower panel such that the bottom holes are aligned with the top holes. The bottom holes are slightly smaller in diameter than the top holes such that sufficient clearance is provided between the game pieces and the top holes to permit the game pieces to fall through the top holes whereas sufficient interference is provided between the game pieces and the bottom holes to prevent the game pieces from falling through the bottom holes in absence of application of the predetermined force upon the upper portions of the game pieces. Also, the lower panel has a plurality of slits therein emanating radially outwardly from each of the bottom holes so as to permit enlargement of each bottom hole sufficient to push a game piece therethrough upon application of the predetermined force upon the game piece. Preferably, each game pieces has a tapered configuration with a maximum diameter smaller than a diameter of the top hole but larger than a diameter of the bottom hole.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
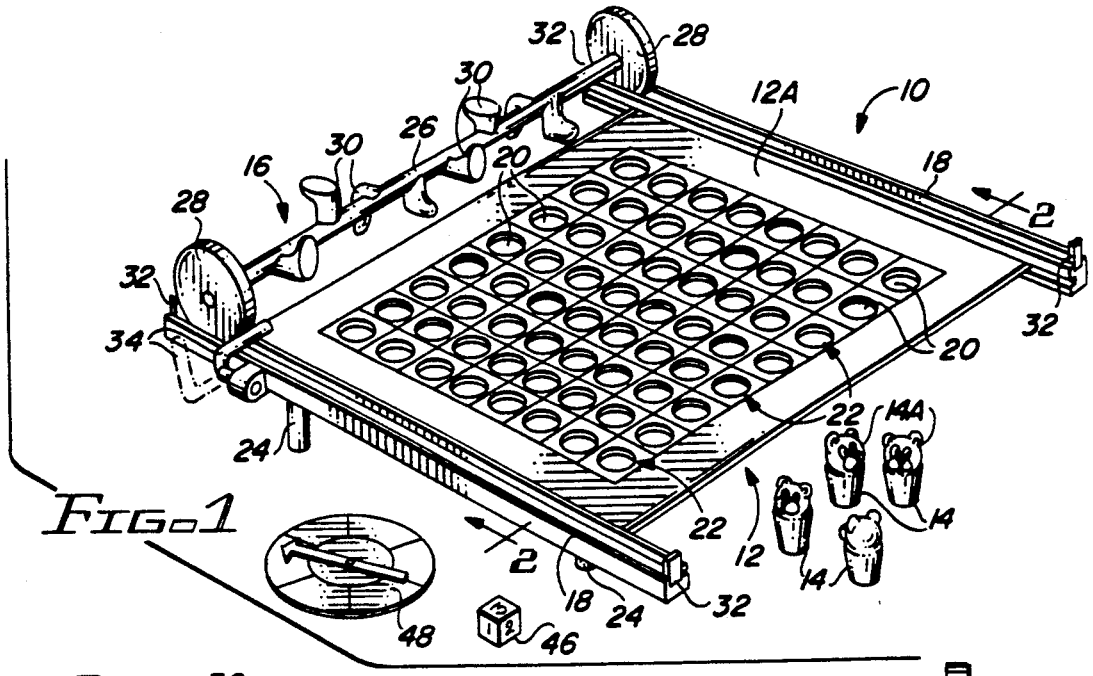
FIG. 1 is a perspective view of an action board game apparatus of the present invention having a game board, a rotary driver movable across the game board, a plurality of playing pieces, and a spinner and dice for directing moves with the game pieces on the game board and release of the rotary driver thereacross.
Figure 2:
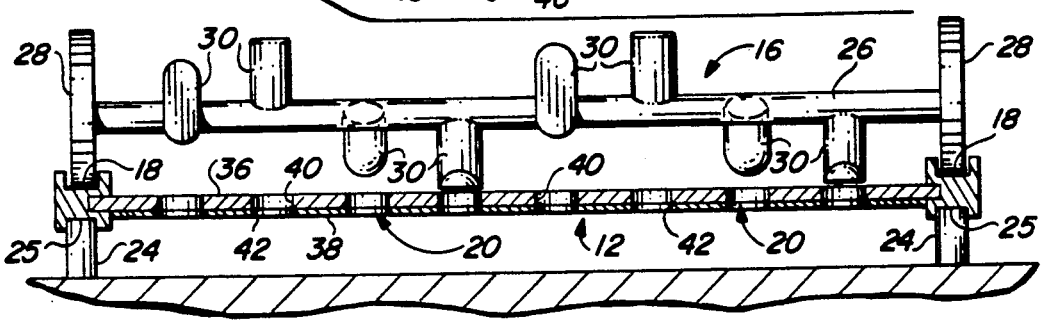
FIG. 2 is an enlarged cross sectional view of the game board apparatus taken along line 2—2 of FIG. 1 showing the rotary driver positioned across the game board.

Referring to the drawings and particularly to FIGS. 1 and 2, there is illustrated an action board game apparatus, generally designated 10, of the present invention. Basically, the action board game apparatus 10 includes a game board 12, a plurality of playing pieces 14, and a rotary driver 16 movable across the game board 12. The game board 12 has a pair of generally parallel linear tracks 18 attached to and extending along opposite side edges 12A thereof. Also, the game board 12 has a plurality of openings 20 defined therein and arranged in an array of side-by-side rows 22 extending generally parallel to one another and to the linear tracks 18.

Referring to FIGS. 1, 2, 6 and 7, the game board 12 is supported in an inclined orientation and spaced relation above a support surface S by any suitable means, such as by pairs of peg-shaped legs 24, mounted below the game board 12. In the illustrated embodiment, the legs 24 are mounted in cylindrical recesses 25 (only one being shown) defined in the undersides of each of tracks 18 adjacent their opposite ends. Corresponding ones of the legs 24 of the pairs thereof are longer than corresponding others of the legs 24 to thereby support the game board 12 in the inclined orientation.

Referring to FIGS. 1–6, the rotary driver 16 includes an elongated shaft 26 and a pair of wheels 28 attached to opposite ends of the shaft 26 for adapting the driver 16 to move across the game board 12 and the wheels 28 to rollably move along the guide tracks 18 with the shaft 26 being spaced above the game board 12 and passing over the upper portions 14A of the game pieces mounted partially through the openings 20 on the game board 12. The rotary driver 16 also includes a plurality of driving elements 30 mounted on the elongated shaft 26 and extending in a radial relation therefrom and in an angularly offset helical relation to one another along and about the shaft. As the rotary driver 16 rollably moves across the game board 12, the driving elements 30 of the driver 16 are brought into alignment with only certain ones of the openings 20 in the rows 22 thereof so as to apply the predetermined force on the upper portion 14A of the game pieces 14 mounted through those certain ones of the openings 20, resulting in pushing of the game pieces 14 therethrough. The ones of the openings 20 which will be aligned with the driving elements 30 are not known in advance of the rotary driver 16 actually rolling across the game board 12.

Referring again to FIG. 1, the tracks 18 have stop elements 32 mounted at the opposite ends of the tracks 18 so as to prevent the rotary driver 16 from rolling off the tracks 18. Also, an actuator element 34 is mounted to at least one of the tracks 18 and is movable between a blocking position, as seen in solid line form in FIG. 1, and an unblocking position, as seen in dashed line form in FIG. 1, relative to the rotary driver 16. In its blocking position, the actuator element 34 extends over the track 18 across the front of one of the wheels 28 of the driver 16 so as to retain the rotary driver 16 at the home or rest position, as shown in FIG. 1, located at the higher ends of the tracks 18. In its unblocking position, the actuator element 34 is pivoted away from the one wheel 28 of the driver 16 so as to permit rolling movement of the driver 16 by itself down the inclined game board 12 toward the lower ends of the tracks 18, until the driver 16 reaches the stop elements 32 located at the lower ends.

Figure 3:
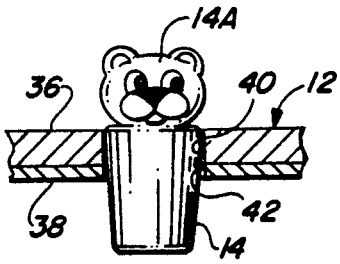
FIG. 3 is an enlarged fragmentary sectional view of the game board showing one game piece disposed partially through an opening in the game board.
Figure 4:
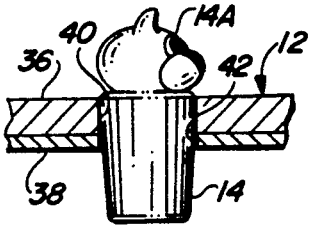
FIG. 4 is another view similar to that of FIG. 3 but with the position of the game piece rotated 90°.
Figure 5:
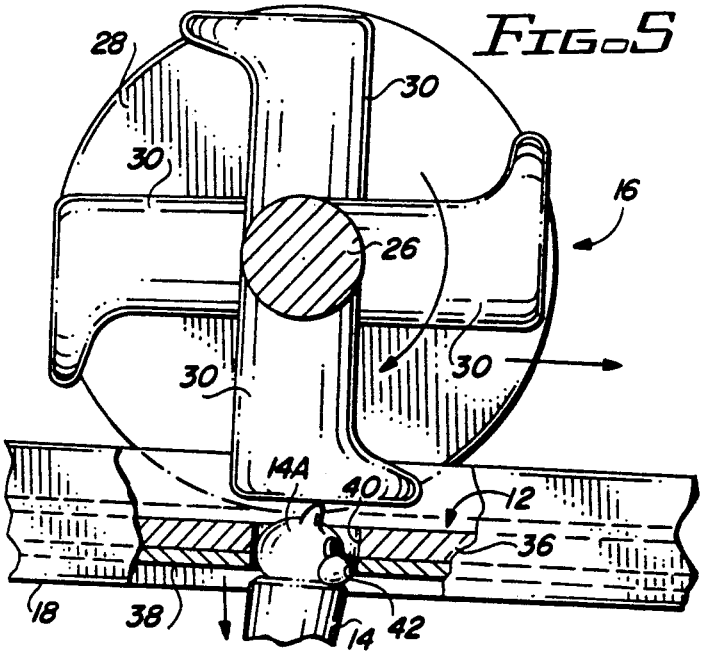
FIG. 5 is an enlarged fragmentary side elevational view showing one of the driving elements on the rotary driver applying a force upon the upper portion of a game piece sufficient to push the game piece downward through the opening in the game board.
Figure 6:
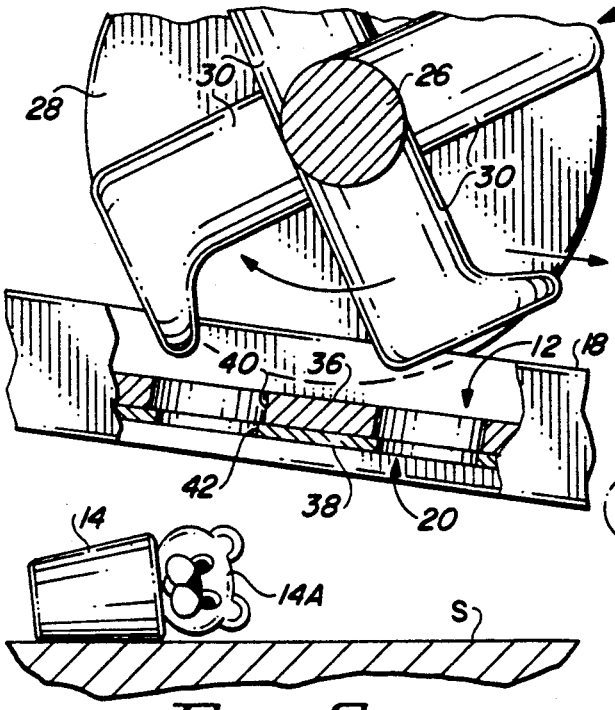
FIG. 6 is another view similar to that of FIG. 5 but after the game piece has dropped below the game board and is resting on a surface supporting the game board.
Figure 8:
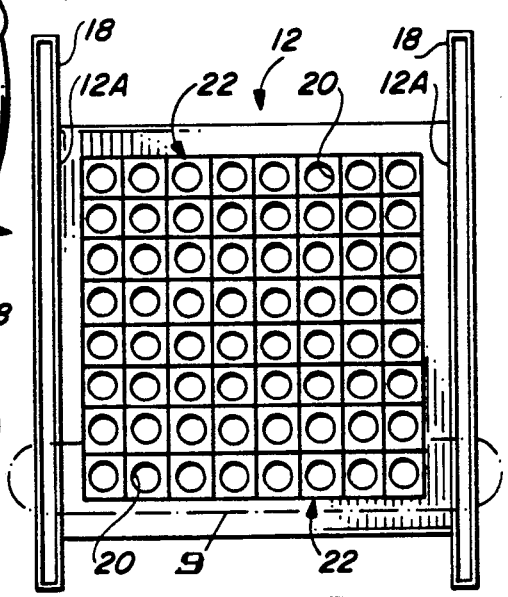
FIG. 8 is a top plan view of the game board and guide tracks.
Figure 7:
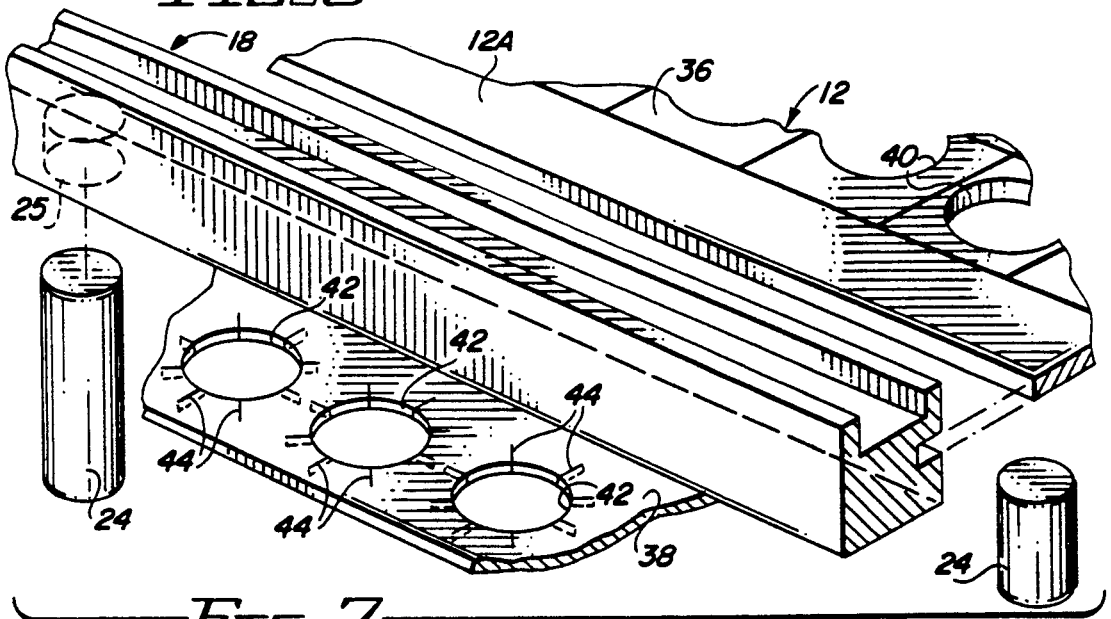
FIG. 7 is an enlarged fragmentary exploded perspective view of a side edge of the game board, a guide track mountable thereto and a pair of legs for supporting the game board in an inclined orientation above a support surface.

Referring to FIGS. 3–6, the game pieces 14 are mountable on the game board 12 partially through selected ones of the openings 20. The size of each game piece 14 relative to the openings 20 is such as to be capable of being pushed through and dropped below the openings 20 upon application of a predetermined force on an upper portion 24 of each game piece 14 extending above the game board 12. More particularly, the game board 12 includes an upper panel 36 made of a substantially rigid material, and a lower panel 38 made of a suitably resiliently flexible material. The openings 20 in the game board 12 include a plurality of top holes 40 formed through the upper panel 36, and a plurality of bottom holes 42 formed through the lower panel 38. The bottom holes 42 are aligned with the top holes 40 and are slightly smaller in diameter size than the top holes 40. The diameter size of the top holes 40 is slightly larger than the maximum diameter size of the game pieces 14. Thus, sufficient clearance is provided between the game pieces 14 and the edges of the upper panel 36 defining the top holes 40 to permit the game pieces 14 to fall through the top holes 40. On the other hand, the diameter size of the bottom holes 42 is slightly smaller than the maximum diameter size of the game pieces 14 so as to provide sufficient interference between the game pieces 14 and the edges of the lower panel 38 defining the bottom holes 42 to prevent the game pieces 14 from falling through the bottom holes 42 in absence of the application of a sufficient force upon the upper portions 14A of the game pieces 14 to overcome the friction applied by the interference. Also, the lower panel 38 has a plurality of slits 44 formed therein emanating radially outwardly from each of the bottom holes 42 so as to permit sufficient enlargement of each bottom hole 42 to result in the pushing of a game piece 14 therethrough upon application of the required level of predetermined force upon game piece 14. As seen in FIGS. 3 and 4, each game piece 14 has a body 14B of a tapered configuration and with a maximum diameter smaller than the diameter of the top hole 40 and larger than the diameter of the bottom hole 42.

Figure 9:
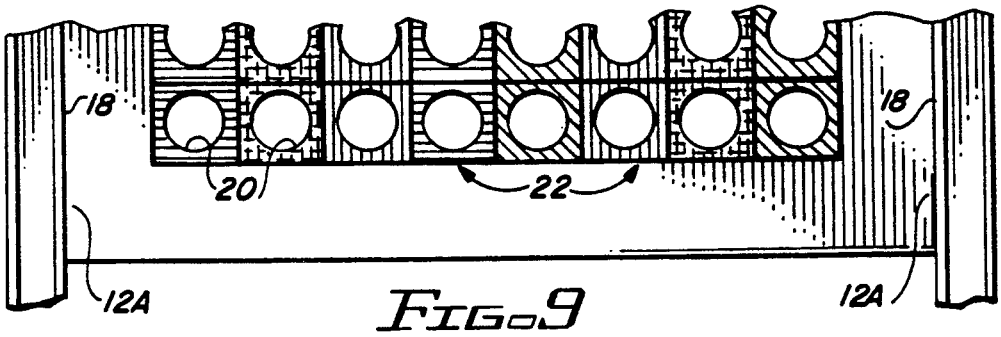
FIG. 9 is an enlarged plan view of the portion of the game board and guide tracks enclosed by the oval 9 of FIG. 8.

Preferably, the driving elements 30 on the rotary driver 16 are in the form of boots capable of stomping or forceably pushing any of the game pieces 14 engaged by the boots through the bottom holes 42 in the lower flexible panel 38 of the game board 12. Also, preferably, the upper portion 14A of each game piece 14 is configured as a gopher's head which is stomped upon by the boot 30. As seen in FIG. 9, the different rows 22 of openings 20 alternate with different colors. The objective in playing the game using the game board 12 and rotary driver 16 is for a player to be able to move his or her game piece 14 laterally across the rows 22 from one side to the other of the game board 12 without the game piece 14 being stomped on by one of the boots 30 each time the driver 16 is allowed to roll down the inclined game board 12. As seen in FIG. 1, a die 46 and spinner 48 can be used for directing the turns of the players and moves with the game pieces 14 on the game board 12 and release of the rotary driver 16 thereacross.

Alternatively, the upper and lower panels 36, 38 could be provided as a one-piece or single panel construction. Also, aperture configurations, other than the holes 40, 42 and slits 44, could be devised. Further, the shape of the game pieces 14 could be modified to work with any selected aperture configuration.

It is thought that the present invention and its advantages will be understood from the foregoing description and it will be apparent that various changes may be made thereto without departing from its spirit and scope of the invention or sacrificing all of its material advantages, the form hereinbefore described being merely the preferred or exemplary embodiment thereof.

I claim:

1. An action board game apparatus, comprising:

(a) a game board having a plurality of openings defined therein and guide means for defining guide tracks;

(b) a plurality of game pieces mountable on said game board partially through selected ones of said openings and capable of being pushed through and dropping below said openings upon application of a predetermined force on an upper portion of each said game piece extending above said game board; and (c) a rotary driver including an elongated shaft and a pair of wheels attached to opposite ends of said shaft for adapting said driver to move across said game board and said wheels along said guide tracks such that said shaft spaced above said game board passes above said upper portions of said game pieces mounted partially through said openings on said game board, said driver also including a plurality of driving elements mounted on said shaft and extending in a radial relation therefrom and in an angular offset relation to one another about said shaft such that as said rotary driver moves across said game board said driving elements of said driver are brought into alignment with only certain ones of said openings which are unknown in advance so as to apply said predetermined force on said upper portion of said game pieces mounted through said certain openings to push said game pieces therethrough.

2. The apparatus of claim 1 wherein said openings in said game board are arranged in an array of generally parallel side-by-side rows.

3. The apparatus of claim 1 wherein said driving elements are disposed in a helical arrangement along and about said shaft.

4. The apparatus of claim 1 wherein said guide tracks includes a pair of generally parallel linear tracks attached to and extending along opposite side edges of said board, said tracks receiving said wheels of said rotary driver therein and being configured to permit rolling movement of said wheels therealong.

5. The apparatus of claim 4 wherein said tracks have stop elements disposed at said opposite ends thereof so as to prevent said rotary driver from rolling off said tracks.

6. The apparatus of claim 4 wherein said guide means also includes an actuator element mounted to at least one of said tracks and being movable between a blocking position relative to said rotary driver wherein said actuator element retains said driver in a home position at corresponding one ends of said tracks and one end of said game board and an unblocking position relative to said rotary driver wherein said actuator element permits movement of said driver across said game board.

7. The apparatus of claim 4 wherein said guide means also includes a pair of legs mounted to undersides of each of said tracks so as to support said game board in a spaced relation above a support surface.

8. The apparatus of claim 7 wherein corresponding ones of said pairs of legs are longer than the others of said pairs of legs so as to support said game board in an inclined orientation above and relative to a support surface such that said rotary driver can roll by itself along said tracks.

9. The apparatus of claim 1 wherein said game board includes:

an upper panel made of a substantially rigid material; and a lower panel made of a resiliently flexible material.

10. The apparatus of claim 9 wherein said openings in said game board include:

means defining a plurality of top holes through said upper panel; and means defining a plurality of bottom holes through said lower panel, said bottom holes being aligned with said top holes.

11. The apparatus of claim 10 wherein said bottom holes are slightly smaller in diameter than said top holes such that sufficient clearance is provided between said game pieces and said top holes to permit said game pieces to fall through said top holes whereas sufficient interference is provided between said game pieces and said bottom holes to prevent said game pieces from falling through said bottom holes in absence of application of said predetermined force upon said upper portions of said game pieces.

12. The apparatus of claim 10 wherein said lower panel has a plurality of slits therein emanating radially outwardly from each of said bottom holes so as to permit sufficient enlargement of said each bottom hole to push a game piece therethrough upon application of said predetermined force upon said game piece.

13. The apparatus of claim 10 wherein each of said game pieces has a tapered configuration with a maximum diameter smaller than a diameter of said top hole and larger than a diameter of said bottom hole.

14. The apparatus of claim 1 wherein each of said driving elements on said rotary driver has a configuration of a boot.

15. The apparatus of claim 1 further comprising:

a plurality of legs mounted to an underside of said game board so as to support said game board in a spaced relation above a support surface.

16. The apparatus of claim 15 wherein corresponding ones of said pairs of legs are longer than the others of said pairs of legs so as to support said game board in an inclined orientation above and relative to a support surface such that said rotary driver can roll by itself along said tracks.

17. An action board game apparatus, comprising:

(a) a game board having a pair of generally parallel linear tracks attached to and extending along opposite side edges of said game board, a plurality of openings defined in said game board and being arranged in an array of side-by-side rows extending generally parallel to one another and to said linear tracks, and means mounted below said game board for supporting said game board above a support surface;

(b) a plurality of game pieces mountable on said game board partially through selected ones of said openings and capable of being pushed through and of dropping below said openings upon application of a predetermined force on an upper portion of each said game piece extending above said game board; and (c) a rotary driver including an elongated shaft and a pair of wheels attached to opposite ends of said shaft for adapting said driver to move across said game board and said wheel to rollably move along said guide tracks with said shaft spaced above said game board and passing above said upper portions of said game pieces mounted partially through said openings on said game board, said driver also including a plurality of driving elements mounted on said shaft and extending in a radial relation therefrom and in an angularly offset helical relation to one another along and about said shaft such that as said rotary driver rollably moves across said game board said driving elements of said driver are brought into alignment with only certain ones of said openings which are unknown in advance so as to apply said predetermined force on said upper portion of said game pieces mounted through said certain openings and push said game pieces therethrough;

(d) corresponding ones of said pairs of legs being longer than others of said pairs of legs so as to support said game board in an inclined orientation above and relative to a support surface such that said rotary driver can roll by itself along said tracks.

18. The apparatus of claim 17 wherein said tracks have stop elements disposed at said opposite ends thereof so as to prevent said rotary driver from rolling off said tracks.

19. The apparatus of claim 18 wherein said guide means also includes an actuator element mounted to at least one of said tracks and being movable between a blocking position relative to said rotary driver wherein said actuator element retains said driver in a home position at corresponding one ends of said tracks and one end of said game board and an unblocking position relative to said rotary driver wherein said actuator element permits movement of said driver across said game board.

20. The apparatus of claim 17 wherein said game board includes:

an upper panel made of a substantially rigid material; and a lower panel made of a resiliently flexible material.

21. The apparatus of claim 17 wherein said openings in said game board includes:

means defining a plurality of top holes through said upper panel; and means defining a plurality of bottom holes through said lower panel, said bottom holes being aligned with said top holes.

22. The apparatus of claim 21 wherein said bottom holes are slightly smaller in diameter than said top holes such that sufficient clearance is provided between said game pieces and said top holes to permit said game pieces to fall through said top holes whereas sufficient interference is provided between said game pieces and said bottom holes to prevent said game pieces from falling through said bottom holes in absence of application of said predetermined force upon said upper portions of said game pieces.

23. The apparatus of claim 22 wherein said lower panel has a plurality of slits therein emanating radially outwardly from each of said bottom holes so as to permit sufficient enlargement of said each bottom hole to push a game piece therethrough upon the application of said predetermined force upon said game piece.

24. The apparatus of claim 22 wherein each of said game pieces has a tapered configuration with a maximum diameter smaller than a diameter of said top hole and larger than a diameter of said bottom hole.

* * * * *